US005810350A

United States Patent [19]

Pollich

[11] Patent Number: 5,810,350

[45] Date of Patent: Sep. 22, 1998

[54] SUCTION TAPE CONVEYOR TABLE

[75] Inventor: Gerhard Pollich, Heidelberg, Germany

[73] Assignee: Heidelberger Druckmaschinen AG, Heidelberg, Germany

[21] Appl. No.: 565,794

[22] Filed: Dec. 1, 1995

[30] Foreign Application Priority Data

Dec. 1, 1994 [DE] Germany ..... 44 42 629.1

[51] Int. Cl.[6] ..... B65H 5/02

[52] U.S. Cl. ..... 271/276; 271/197

[58] Field of Search ..... 271/196, 197, 271/276; 198/689.1

[56] References Cited

U.S. PATENT DOCUMENTS

| | | | |
|---|---|---|---|
| 5,031,002 | 7/1991 | Yaguchi | 271/196 X |
| 5,133,543 | 7/1992 | Eitel et al. | 271/276 |
| 5,288,067 | 2/1994 | Stock | 271/276 |
| 5,531,313 | 7/1996 | Maass | 271/197 X |

FOREIGN PATENT DOCUMENTS 4040485 7/1992 Germany .

*Primary Examiner*—Boris Milef

*Attorney, Agent, or Firm*—Herbert L. Lerner; Laurence A. Greenberg

[57] ABSTRACT

Device for conveying a stream of sheets to a sheet-processing machine having a conveyor table with endless transport tapes formed with through-holes and drivable around the conveyor table, and a suction box arranged below the conveyor table and connected with an underside of the transport tapes via suction openings formed in the feed table includes three suction chambers formed in the suction box and extending in succession in a sheet transport direction, the suction chambers including a first suction chamber subjectible to underpressure by a first vacuum source, a third suction chamber facing towards the sheet-processing machine, and a second and middle suction chamber subjectible in common with the third suction chamber to underpressure by a second vacuum source.

7 Claims, 2 Drawing Sheets

SUCTION TAPE CONVEYOR TABLE

BACKGROUND OF THE INVENTION

FIELD OF THE INVENTION

The invention relates to a suction tape conveyor table such as a feed table which provides a device for conveying, in particular, a shingled or imbricated stream of sheets to a sheet-processing machine.

The conveyance of a shingled stream of sheets on the feed table of a feeder of a sheet-fed rotary printing press may be divided into three phases.

In the first phase, the first sheet, which has moved at the start-up of the printing press from a separator or singling device onto a suction tape, is to be sucked onto the perforated transport tape with as little slippage as possible. In this phase of the press operation, however, the suction force is basically reduced because only a limited area of the transport tape is covered by the first sheet and, therefore, a considerable amount of unused air is sucked up, so that the suction effect is limited. This first phase may become especially critical if the operation is performed with a short shingle length and without having pulleys on the tape drive roller at the upper end of the feed table.

Stable or constant operating conditions prevail in the second phase, namely during the conveyance of the shingled sheet stream, when the system appears to be in a rather steady or transient state; this second phase is therefore classifiable as non-problematic.

The third phase of conveyance of a shingled sheet stream concerns the conveyance of the last sheet of the shingled sheet stream. The entire length of this last sheet is sucked onto the transport tape and is thus fixed on the transport tape considerably tighter than the sheets of the shingled sheet stream which partially overlap one another. In the shingled stream, the overlapping of the individual sheets has the effect that the sheets are in contact with the transport tape only with a fraction of their surface: consequently, they are subjected to a reduced suction effect. If the last sheet, during its transport to the front lays, remains subjected to the underpressure prevailing in the feed table, the leading edge of the last sheet can be damaged at the front lays, on the one hand, and the lateral alignment of the sheet can be considerably obstructed, on the other hand.

In the German Published Non-Prosecuted Patent Application DE-OS 38 38 078, a device is described for conveying, in particular, a shingled stream of sheets to a sheet-processing machine, wherein two different suction boxes subjectible to suction air or vacuum are arranged behind one another in the transport direction.

The device according to the aforementioned published German Application DE-OS 38 38 078 has a disadvantage in that especially the first sheet conveyed from a pile of sheets (corresponding to the first phase described hereinbefore) is inadequately held and accelerated by the transport tape.

SUMMARY OF THE INVENTION

It is accordingly an object of the invention of the instant application to provide a suction tape conveyor or feed table which represents a device for conveying, in particular, a shingled stream of sheets to a sheet-processing machine, in a manner considerably improved over that for conventional devices of this general type.

With the foregoing and other objects in view, there is provided, in accordance with the invention, a device for conveying a stream of sheets to a sheet-processing machine having a conveyor table with endless transport tapes formed with through-holes and drivable around the conveyor table, and a suction box arranged below the conveyor table and connected with an underside of the transport tapes via suction openings formed in the feed table, comprising three suction chambers formed in the suction box and extending in succession in a sheet transport direction, the suction chambers including a first suction chamber subjectible to underpressure by a first vacuum source, a third suction chamber facing towards the sheet-processing machine, and a second and middle suction chamber subjectible in common with the third suction chamber to underpressure by a second vacuum source.

In accordance with another feature of the invention, the conveying device includes a suction roller located between a sheet pile and the conveyor table, the suction roller being subjectible to underpressure together with the first suction chamber by the first vacuum source.

In accordance with a further feature of the invention, each of the suction roller and the first suction chamber is connected to its own vacuum source.

In accordance with an added feature of the invention, the suction roller is formed with a plurality of suction holes distributed over the circumference thereof, the suction holes, in a region of the circumference of the suction roller facing towards a sheet, being subjectible to underpressure of a given level.

In accordance with an additional feature of the invention, the suction roller is a guide roller for at least one of the transport tapes.

In accordance with yet another feature of the invention, the suction roller is drivably mounted.

In accordance with yet a further feature of the invention, the suction holes, respectively, formed in the suction roller are arranged laterally of at least one of the transport tapes.

In accordance with yet an added feature of the invention, the at least one transport tape is guided in a groove formed in the suction roller.

In accordance with a concomitant feature of the invention, at least one of the transport tapes is guided slip-free over the suction holes formed in the suction roller, and the through-holes formed in the at least one transport tape are arranged so as to can be bringable into correspondence with the suction holes formed in the suction roller.

In an advantageous manner, both the first as well as the last sheet of a printing job are thus conveyed reliably from the sheet pile to the front lays, even at high printing speeds.

In one embodiment of the invention, there is provided between the sheet pile and the first suction chamber a suction roller which is subjectible to an underpressure coming from the same vacuum source as that from which the underpressure in the first suction chamber comes. Through this measure, timing or cyclic rollers or pulleys conventionally disposed between the sheet pile and the conveyor or feed table can be eliminated.

In a further embodiment of the inventive concept, a respective individual vacuum source is assigned to each of the first suction chamber and the suction roller. Due to this feature, the effect of unused air, when suction openings are not covered, is minimized.

In an advantageous manner, the suction roller simultaneously functions as a guide roller for the one or more transport tapes of conveyor or feed table.

So that no blocking of the suction holes in the suction roller can take place due to slippage, these suction holes in the suction roller are preferably arranged laterally of the transport tape. In order to minimize the influence of unused air thereat also, the one or more transport tape are guided in grooves, so that little or no space exists between the upper side of the transport tape and the circumferential surface of the suction roller.

A transport tape, which is drivable slip-free with respect to the suction roller and may be constructed, for example, as a toothed belt, is guided over the suction roller or is driven thereby in a manner that the suction holes formed in the suction roller can be brought into correspondence with the through-holes formed in the transport tape.

Other features which are considered as characteristic for the invention are set forth in the appended claims.

Although the invention is illustrated and described herein as embodied in a suction tape conveyor table, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying figures of the drawing.

DESCRIPTION OF THE PREFERRED EMBODIMENTS

Figure 1:
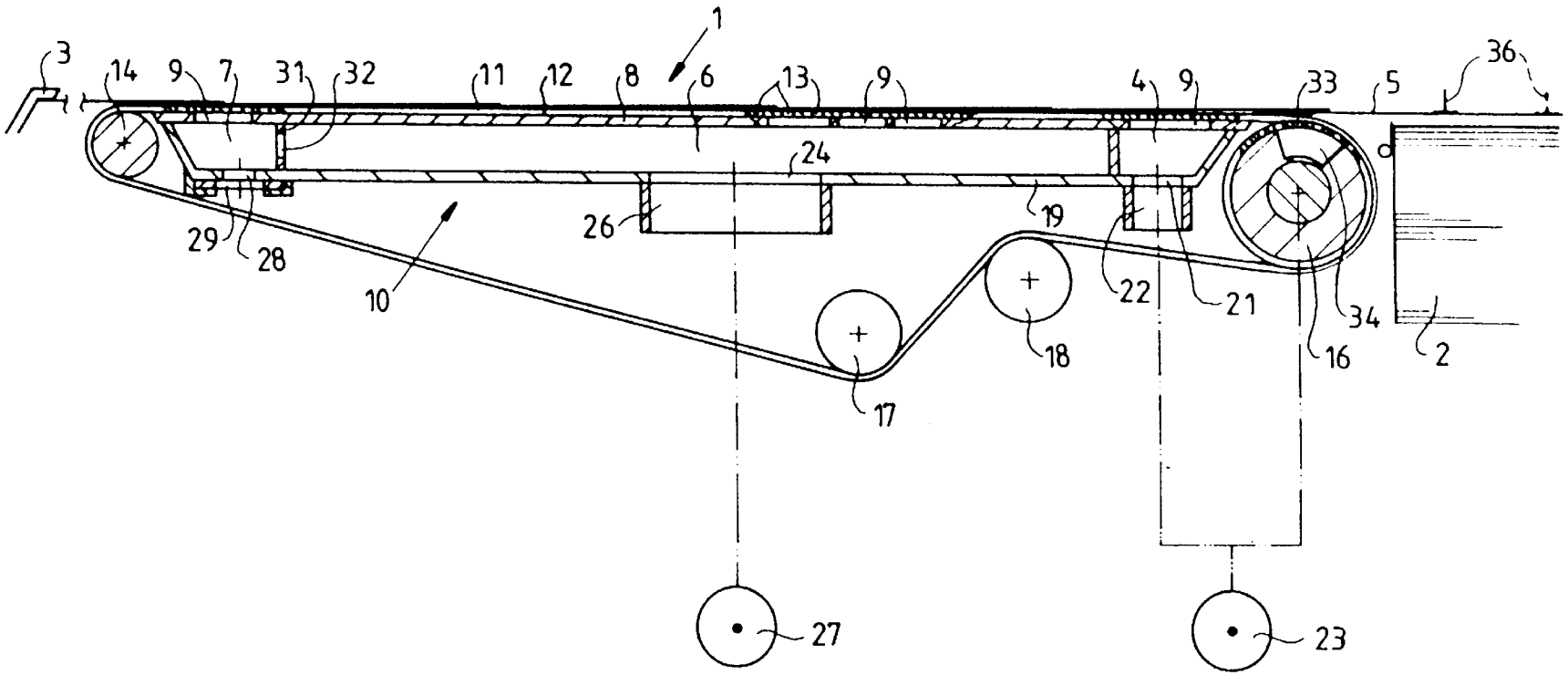
FIG. 1 is a diagrammatic and schematic side elevational view, partly in section, of a feed table of a sheet feeder forming part of the invention.

Referring now to the figures of the drawing, and first, particularly to FIG. 1, there is shown therein a feed table 1 arranged between a sheet pile 2 and front lays 3 of a sheet-processing machine (for example, a printing press) and having a suction box 10 located in a sheet transport direction, the suction box 10 being formed with three suction chambers 4, 6, 7 which are arranged below a table top 8. The table top 8 has at least one row of suction holes 9 arranged successively in the transport direction. At least one drivable endless transport tape 11 is guided around the feed table 1 in such a manner that it slides on a surface 12 or, selectively, in a non-illustrated respective groove provided therefor. The transport tape 11 has a number of perforations in the form of through-holes 13 formed therein and arranged so as to correspond with the suction holes 9 formed in the table top 8. The transport tape 11, at the side of the feed table 1 facing towards the printing press, is guided over a guide roller 14 and, at the side thereof facing towards the pile 2, the transport tape 11 is guided over a suction roller 16 and, below the feed table 1, is guided over guide rollers 17 and 18.

The guide rollers 17 and 18 are rotatably mounted or journalled in side frames, with one of the guide rollers 17, 18 having conventional means for adjusting the guide rollers 17, 18 and thereby tensioning the transport tape 11. The guide roller 14 is drivably mounted in the side frame. The suction roller 16 is rotatably mounted or journalled in the side frames. Of course, it is also feasible to mount the guide roller 14 rotatably and the suction roller 16 drivably.

The suction chamber 4 has at least one opening 21 formed in a base plate 19 thereof, the opening 21 being connected to a first vacuum source 23 via a connecting piece 22. The suction roller 16 is connected to the same vacuum source 23 by a suitable non-illustrated rotatable inlet, so that both the suction roller 16 and the suction chamber 4 can simultaneously be subjected to underpressure or vacuum from the same vacuum source 23.

Figure 2:
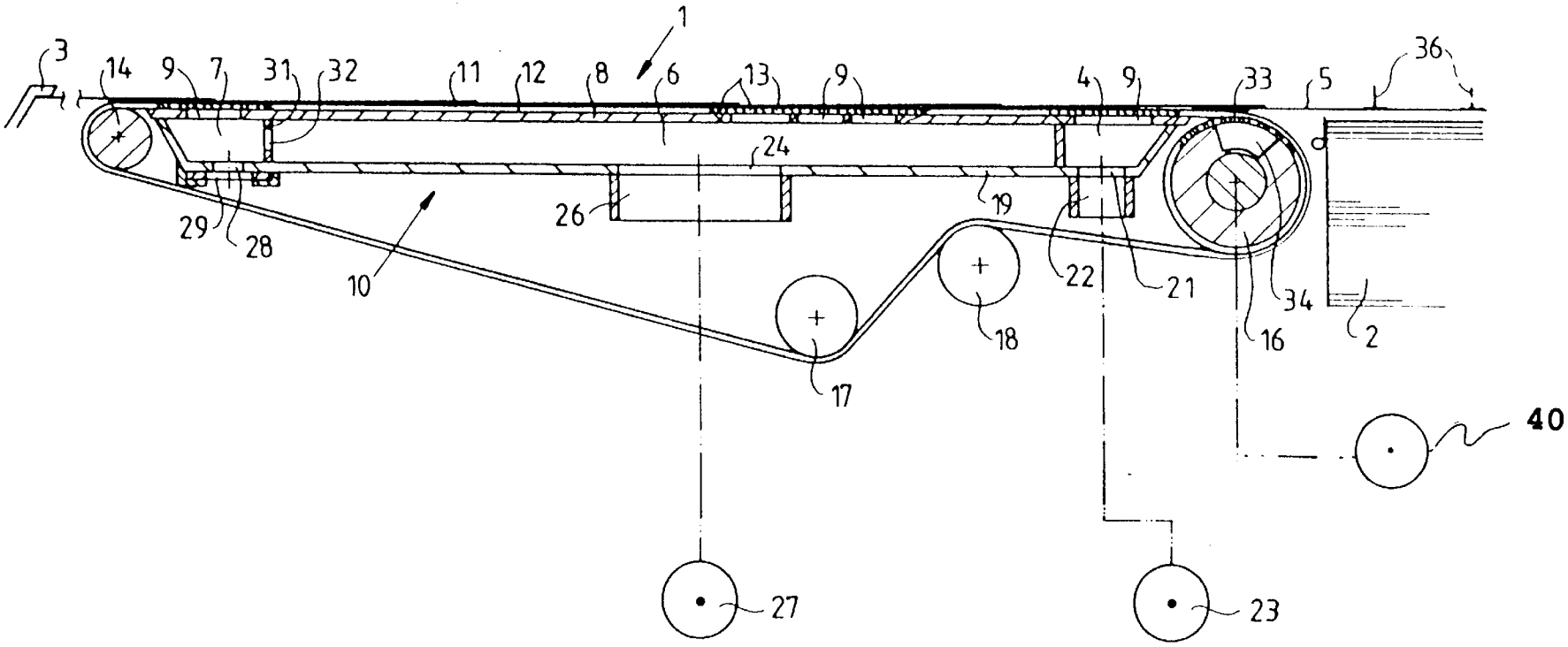
FIG. 2 is a diagrammatic and schematic side elevational view, partly in section, of a second embodiment of the feed table.

A further embodiment of the invention, the suction roller 16 and the suction chamber 4, respectively, have their own vacuum source 40 and 23, respectively as shown in FIG. 2. Assurance is thereby provided that unused air entering the suction holes 9 in the region of the suction chamber 4 while the suction holes 9 are in an unblocked state has no influence on the negative pressure or underpressure level of the suction roller 16.

The middle suction chamber 6 has an opening 24 formed in the base plate 19 thereof, the opening 24 being connected to a second vacuum source 27 via a connecting piece 26.

The suction chamber 7 has at least one opening 28 formed in the base plate 19 thereof, the opening 28 being connected to ambient air. A slide valve 29 arranged so that it can close the opening 28 is provided for regulating the underpressure or negative pressure level of the suction chamber 7.

A common partition 31 between the suction chamber 6 and the suction chamber 7 is formed with at least one opening 32 through which the suction chamber 7 can be subjected to underpressure or negative pressure from the vacuum source 27.

The suction roller 16 is formed with a number of suction holes 33 disposed in a row distributed over the circumference thereof, preferably, respectively arranged laterally of the transport tape 11. The suction roller 16 is subjectible to underpressure or negative pressure in a circumferential region 34 thereof facing towards a sheet 5 which is to be transported.

In a further development of the inventive concept, the transport tape 11 is guided slip-free over the suction holes 33 formed in the suction roller 16, so that the suction holes 33 can be brought into correspondence with the through-holes 13 formed in the transport tape 11. It is consequently possible, for example, to provide the transport tape 11 with a toothing at the underside thereof, the toothing engaging in corresponding toothing formed on the respective drive roller.

In the feeding of sheets to the printing press, a first sheet 5 is transported by means of one or more forwarding or pull suckers 36, until a forward or leading region of the sheet 5 reaches the suction roller 16. Due to the underpressure or negative-pressure level existing in the region 34 of the suction roller 16, the sheet 5 is fed to the transport tape 11.

From the suction roller 16, the sheet 5 is moved into the working region of the first suction chamber 4 by means of the transport tape 11. The high underpressure or negative-pressure level existing at the suction roller 16 and the suction chamber 4 effectively causes the sheet 5 to attain the conveying speed without any significant slippage with respect to the transport tape 11 and to reach the working region of the suction chamber 6. Because the sheet 5 exhibits a steady or constant transport speed in this region, it is a relatively non-critical region.

Particularly for the lateral alignment at the front lays 3, it is necessary that the holding force of the suction be diminished in the region of the suction chamber 7. For this purpose, atmospheric pressure is conducted through the opening 28 by means of the slide valve 29, with the effect that the pressure level in the suction chamber 7 is changed relative to the pressure existing in the suction chamber 6, i.e., the underpressure or negative pressure in the suction chamber 7 is lower than in the suction chamber 6.

In order to be able also to laterally align, in the region of the front lays 3, the last sheet 5, the entire surface of which lies on the feed table 1 and is thus subjected to relatively strong suction, the first vacuum source 23 and the second vacuum source 27, as well, are switched off during sheet transport. Conventional means for venting the suction chamber 6 may also be provided. A result thereof is that, only in the regions of the suction chambers 6 and 7, does an adequate underpressure or negative-pressure level still exist which causes the sheet 5 to remain in contact with the transport tape 11 during the lateral alignment, and to undergo a thrust forward against the front lays 3.

I claim:

1. Device for conveying a stream of sheets to a sheet-processing machine, comprising:

a conveyor table with endless transport tapes formed with through-holes and drivable around said conveyor table, said transport tapes having an underside and said conveyor table having suction openings formed therein;

a suction box disposed below said conveyor table and connected with said underside of said transport tapes via said suction openings formed in said conveyor table;

three suction chambers formed in said suction box and extending in succession in a sheet transport direction, said suction chambers including a first suction chamber subjectible to underpressure by a first vacuum source, a third suction chamber facing towards the sheet-processing machine, and a second and middle suction chamber subjectible in common with said third suction chamber to underpressure by a second vacuum source;

a suction roller located between a sheet pile and said conveyor table, said suction roller being subjectible to underpressure together with said first suction chamber by said first vacuum source; and said suction roller having a plurality of suction holes distributed over the circumference thereof, said suction holes, in a region of said circumference of said suction roller facing towards a sheet, and being subjectible to underpressure of a given level.

2. Device according to claim 1, wherein each of said suction roller and said first suction chamber is connected to its own vacuum source.

3. Device according to claim 1, wherein said suction roller is a guide roller for at least one of the transport tapes.

4. Device according to claim 1, wherein said suction roller is drivably mounted.

5. Device according to claim 1, wherein said suction holes, respectively, formed in said suction roller are arranged laterally of at least one of the transport tapes.

6. Device according to claim 5, wherein the at least one transport tape is guided in a groove formed in said suction roller.

7. Device according to claim 1, wherein at least one of the transport tapes is guided slip-free over said suction holes formed in said suction roller, and the through-holes formed in the at least one transport tape are arranged so as to can be bringable into correspondence with said suction holes formed in said suction roller.

* * * * *